US006776232B2

(12) United States Patent
Skillman

(10) Patent No.: US 6,776,232 B2
(45) Date of Patent: Aug. 17, 2004

(54) INSERT ROD GUIDE

(76) Inventor: Milton Skillman, Rte. 1 Box 216, Mount Vernon, TX (US) 75457

( * ) Notice: Subject to any disclaimer, the term of this patent is extended or adjusted under 35 U.S.C. 154(b) by 67 days.

(21) Appl. No.: 10/201,127

(22) Filed: Jul. 22, 2002

(65) Prior Publication Data

US 2004/0011518 A1 Jan. 22, 2004

(51) Int. Cl.[7] ..... E21B 17/10
(52) U.S. Cl. ..... 166/241.4; 166/84.1
(58) Field of Search ..... 166/68, 69, 105–105.4, 166/241.4, 241.2, 84.1, 84.5

(56) References Cited

U.S. PATENT DOCUMENTS 5,058,668 A * 10/1991 Newton ..... 166/84.1
5,632,335 A * 5/1997 Campbell et al. ..... 166/105
6,368,084 B1 4/2002 Skillman ..... 53/12

* cited by examiner

*Primary Examiner*—Zakiya Walker
(74) *Attorney, Agent, or Firm*—Russell J. Egan

(57) ABSTRACT

An insert rod guide has an elongated cylindrical member with an externally threaded first or upper end of a first diameter and an internally threaded lower or second end of a larger diameter with an axial bore extending between the ends. Intermediate the ends of the member is a truncated conical shoulder with a plurality of regularly spaced bores angled outwardly from the axial bore through the shoulder. An annular sand shield is mounted externally on the member for axial movement therealong. The sand shield has one face which is tapered to mate with the shoulder. An annular hardened insert is mounted on the upper end of the member and is held in place by retainer collar.

4 Claims, 2 Drawing Sheets

INSERT ROD GUIDE

BACKGROUND OF THE INVENTION

1. The Field of the Invention

The present invention pertains to insert rod guides used with beam pumping wells and, more particularly, to rod guides used with beam pumping wells in which a reciprocating sucker rod operates a downhole pump.

2. The Prior Art

The insert rod guide of the present invention replaces the standard rod guide in those pumping applications where the fluid produced from the well contains abrasives or where the well is characterized by a crooked well bore or where the well is a horizontal well The standard prior art insert rod guide used in beam pumping wells is typically made of a single piece of metal machined with standard tooling. The rod, which actually moves up and down as it passes through a standard rod guide, is generally made from a metal which has about the same hardness as a stationery rod guide.

When fluid produced by a reciprocating downhole pump contains abrasive material, such as sand or dirt, these abrasives accelerate rod wear within the rod guide and can actually cut through the rod guide and render it unusable. When the insert rod guide is in constant contact with the reciprocating valve rod, rod wear from the rod guide typically occurs over the entire length of the sucker rod stroke. Accordingly, if the insert rod guide is not properly monitored for wear, the reciprocating sucker rod can actually cut through the rod guide. Without a proper insert rod guide, the rod will cut into the barrel of the pump resulting in the requirement for replacement of both the insert rod guide and the pump barrel. This is an extremely expensive repair. Additionally, if the downhole pump is used in gassy wells, or it is used in a well characterized by the production of a lot of trash, operators will "tag" the pump, this is lowering the sucker rod string until the valve rod bushing hits the rod guide on each down stroke. The female clutch on the rod guide may be ruined and replacement of the rod guide will be necessary, even if the rod guide is not otherwise worm. With the present insert rod guide, only the female clutch (retainer collar) will need to be replaced.

For a description of reciprocating pumps of the type used for producing fluids from subsurface wells, reference is made to my U.S. Pat. No. 6,368,084, the disclosure of which is incorporated herein by reference.

SUMMARY OF THE INVENTION

The subject insert rod guide has an elongated cylindrical member with an externally threaded first or upper end of a first diameter and an internally threaded lower or second end of a larger diameter and a profiled axial bore extending between the ends. Intermediate the ends of the member is an outwardly directed, external, truncated conical shoulder. A plurality of regularly spaced bores angled outwardly from the axial bore through the shoulder. An annular sand shield is mounted on the member for axial movement therealong. The sand shield has one face tapered to mate with the shoulder. An annular hardened insert is mounted on the upper end of the member and is held in place by retainer collar. The sand shield covers the plurality of angled bores when fluid is not being pumped.

BRIEF DESCRIPTION OF THE DRAWINGS

The present invention will now be described, by way of example, with reference to the accompanying drawings in which.

DETAILED DESCRIPTION OF THE INVENTION

Figure 1:
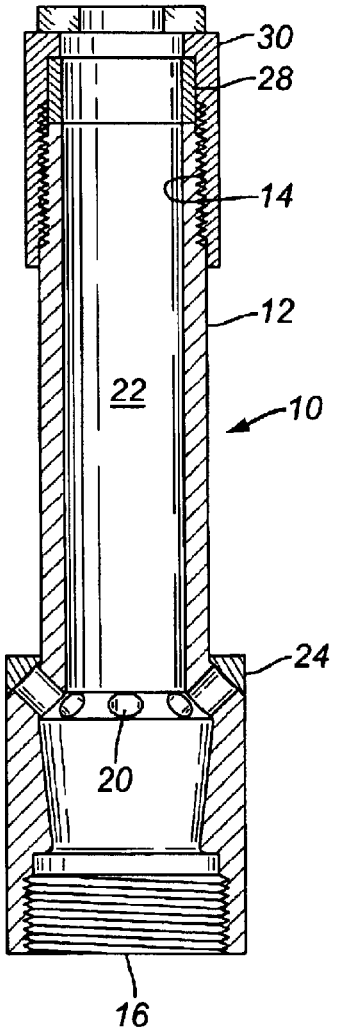
FIG. 1 is a longitudinal section through the subject invention in a first or closed condition.
Figure 2:
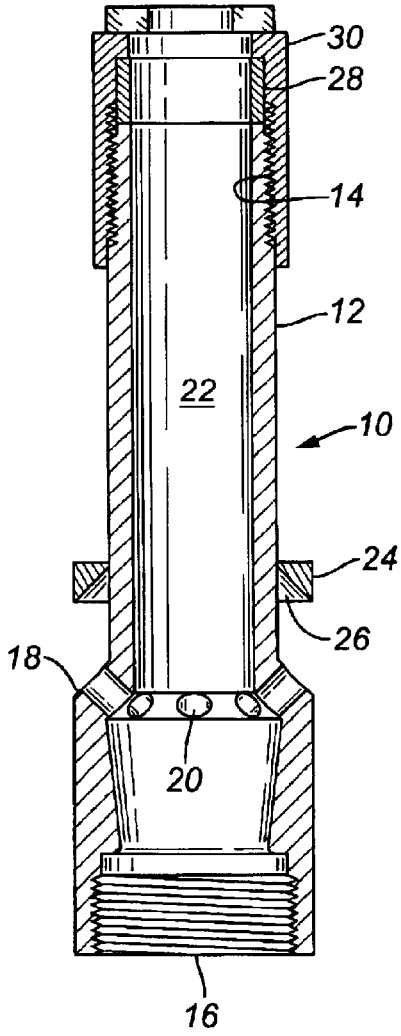
FIG. 2 is a longitudinal section, similar to FIG. 1, through the subject invention in a second or open condition.
Figure 3:
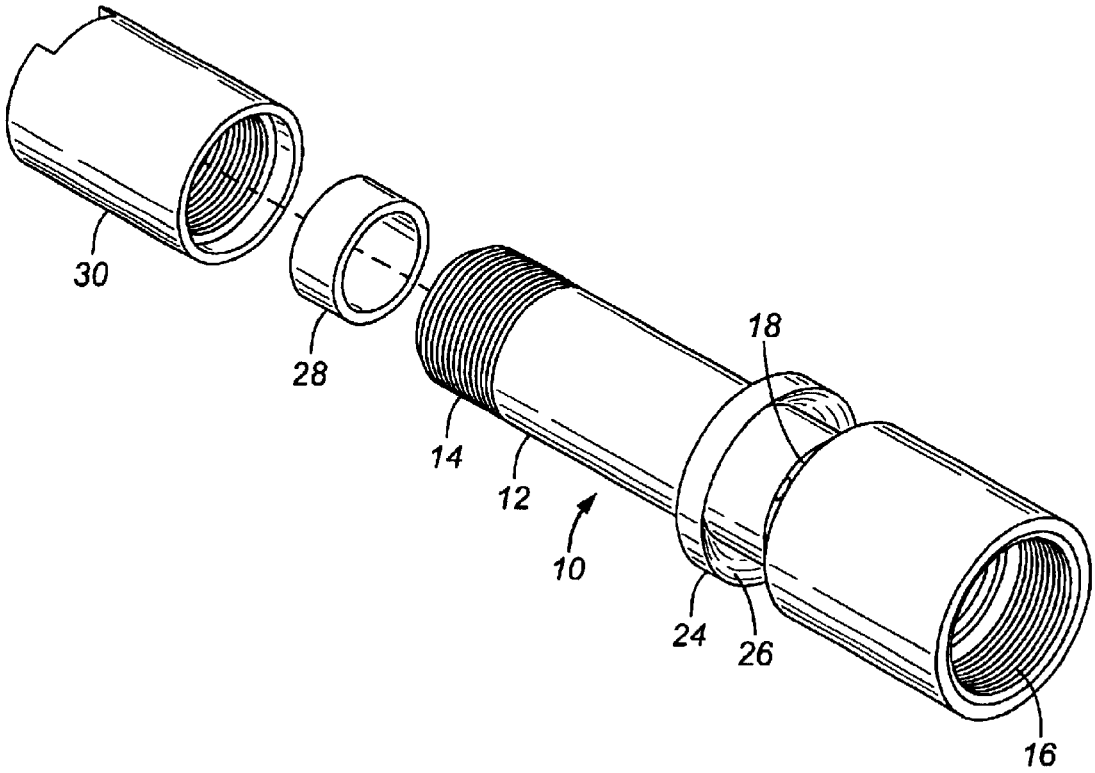
FIG. 3 is an exploded perspective view of the subject invention.

The subject insert rod guide 10 is an elongated cylindrical member 12 having an externally threaded first or upper end 14 of a first diameter and an internally threaded lower or second end 16 of a larger diameter. Intermediate the ends of the member 12, and on the exterior surface thereof, is a truncated conical shoulder 18. A plurality of regularly spaced bores 20 angle outwardly from the axial bore 22 through the shoulder 18. An annular sand shield 24 is mounted on the member 12 for axial movement therealong. The sand shield 24 has one face 26 which is tapered to mate with the shoulder 18. An annular hardened insert 28 is mounted on the upper end 14 of the member 12 and is held in place by retainer collar 30.

The annular hardened insert 28 at the top of the insert rod guide 10 is preferably made of carbide or ceramic, but it could be made of any material which exhibits significant wear resistance. A hardness of 92 Rockwell C or harder has been found to be desirable. The hardened insert 28 could be made of ceramic or a more exotic material, such as those including carbon, boron and/or nitrogen. The reciprocating sucker rods (not shown) pass through the annular hardened insert 28.

The annular hardened insert 28 lowers the coefficient of friction between the reciprocating sucker rod (not shown) and the insert rod guide 10. This reduction in sliding friction reduces both rod wear and insert rod guide wear. Additionally, the sliding clutch is replaceable, making repairs to a pump inexpensive in that the entire insert rod guide 10 need not be replaced. A threaded retaining collar 30 holds the annular hardened insert 28 in position at the top of the insert rod guide assembly.

Toward the bottom of the insert rod guide 10 is a sand shield assembly formed by the annular sand shield 24 and the shoulder 18. This sand shield 24 covers the holes 20 in the shoulder 18 of the rod guide when the fluid is expelled.

When a pump is shut down, typically solids settle out of the fluid being pumped into the tubing, enter the pump, and then settle on top of the plunger. When the pumping unit is started again, the sand or the trash which settled on top of the pump wedges between the plunger and the barrel. This sand or trash typically sticks the pump plunger in position. When a pump plunger is stuck in position, it is possible to either throw the bridle off the horse head at the top end of the pump or actually unseat the pump from its downhole mounting. The sand shield at the bottom of the subject insert rod guide prevents sand from entering the pump through the holes in the insert rod guide during periods of pump shutdown.

Another feature that the subject sand shield assembly provides is assistance with gas lock. On the upstroke, fluid is lifted above the plunger. This lifting action pushes the fluid through the holes in the rod guide. At the same time, fluid is flowing into the pump barrel into the space just below the plunger. If gas enters the pump barrel along with the fluid, it can be hard to create enough pressure between the standing and traveling valve to overcome the hydrostatic level of the tubing on the traveling valve with the next downstroke. There is a close tolerance between the rod guide and the valve rod so that the plunger will fall at a rate faster than the fluid can pass between the rod and the rod guide. The sand shield seals the discharge holes in the insert rod guide on the upstroke of the pump. This sealing of the discharge holes in the insert rod guide then creates a low pressure area above the traveling valve as the plunger falls back into the pump barrel. This low pressure area results in less pressure being required between the standing valve and the traveling valve to open up the traveling valve to operate the pump.

The present invention may be subject of modification and change without departing form the spirit or essential characteristics thereof. The present specification should be considered in all respects as illustrative and not restrictive of the scope of the invention as defined by the appended claims.

I claim:

1. An insert rod guide comprising:

an elongated cylindrical member having an externally threaded first or upper end and an internally threaded lower or second end, a profiled axial bore extending between said ends, an outwardly directed shoulder intermediate said ends, said shoulder having a truncated conical configuration, and a plurality of regularly spaced bores extending outwardly from said axial bore through said shoulder, said bores being angled to open on said truncated conical surface, an annular sand shield mounted on said member for axial movement therealong, said sand shield having one face adapted to mate with said shoulder of said cylindrical member:

an annular hardened insert mounted on the upper end of the cylindrical member; and a retainer collar engaging said externally threaded upper end to hold said hardened insert in place whereby said annular sand shield opens and closes said bores on the down stroke and up stroke, respectively.

2. An insert rod guide according to claim 1 wherein said first or upper end of said member has a first diameter and said internally threaded lower or second end of said member has a larger second diameter.

3. An insert rod guide comprising:

an elongated cylindrical member having an externally threaded first or upper end and an internally threaded lower or second end, a profiled axial bore extending between said ends, an outwardly directed shoulder intermediate said ends, said shoulder having a truncated conical configuration, and a plurality of regularly spaced bores extending outwardly from said axial bore through said shoulder, said annular sand shield having one truncated conical face adapted to mate with said truncated conical shoulder of said cylindrical member, an annular sand shield mounted on said member for axial movement therealong, said sand shield having one face adapted to mate with said shoulder of said cylindrical member:

an annular hardened insert mounted on the upper end of the cylindrical member; and a retainer collar engaging said externally threaded upper end to hold said hardened insert in place whereby said annular sand shield opens and closes said bores on the down stroke and up stroke, respectively.

4. An insert rod guide according to claim 3 wherein said first or upper end of said member has a first diameter and said internally threaded lower or second end of said member has a larger second diameter.

* * * * *